US007032781B2

(12) United States Patent
Van Der Klaauw et al.

(10) Patent No.: US 7,032,781 B2
(45) Date of Patent: Apr. 25, 2006

(54) DRINK DISPENSER ASSEMBLY AND CONTAINER FOR DRINK AND DRINK DISPENSING LINE

(75) Inventors: Guido Petrus Johannes Van Der Klaauw, Hilversum (NL); Bart Jan Bax, Den Haag (NL); Marius Corstiaan Van Duuren, Poortugaal (NL)

(73) Assignee: Heineken Technical Services B.V., Zoeterwoude (NL)

( * ) Notice: Subject to any disclaimer, the term of this patent is extended or adjusted under 35 U.S.C. 154(b) by 0 days.

(21) Appl. No.: 10/869,926

(22) Filed: Jun. 18, 2004

(65) Prior Publication Data

US 2004/0226967 A1 Nov. 18, 2004

Related U.S. Application Data

(62) Division of application No. 10/296,986, filed as application No. PCT/NL01/00423 on May 31, 2001.

(30) Foreign Application Priority Data

May 31, 2000 (NL) ..... 1015368

(51) Int. Cl.
*B67D 5/62* (2006.01)

(52) U.S. Cl. ..... 222/146.6; 222/1; 222/399; 62/389

(58) Field of Classification Search ..... 222/146.6, 222/400.7, 399, 1, 105, 129.1, 129.2, 396–397; 62/389–390, 396
See application file for complete search history.

(56) References Cited

U.S. PATENT DOCUMENTS

| | | | | | |
|---|---|---|---|---|---|
| 1,760,847 | A | * | 5/1930 | Garhart | 222/562 |
| 2,065,949 | A | * | 12/1936 | Sandell | 62/185 |
| RE20,981 | E | * | 1/1939 | Riesco | 62/390 |
| 2,199,503 | A | * | 5/1940 | Martin | 62/393 |
| 2,230,905 | A | * | 2/1941 | Popky | 62/285 |
| 2,506,843 | A | * | 5/1950 | Seiler | 165/104.34 |
| 2,677,255 | A | * | 5/1954 | Wright | 62/259.1 |
| 2,771,752 | A | * | 11/1956 | Tennant | 62/224 |
| 2,788,649 | A | * | 4/1957 | Tunt | 62/390 |
| 2,792,692 | A | * | 5/1957 | Bryan | 62/306 |
| 3,232,489 | A | * | 2/1966 | Buffington | 222/108 |
| 3,889,487 | A | * | 6/1975 | Frankfurt | 62/99 |
| 4,164,853 | A | * | 8/1979 | McDonough | 62/457.1 |
| 4,220,048 | A | * | 9/1980 | Grepiotis et al. | 73/323 |
| 4,350,267 | A | * | 9/1982 | Nelson et al. | 222/131 |
| 5,058,780 | A | | 10/1991 | Plester et al. | |
| 5,560,522 | A | | 10/1996 | Clark | |
| 5,564,602 | A | * | 10/1996 | Cleland et al. | 222/146.6 |

FOREIGN PATENT DOCUMENTS

| | | |
|---|---|---|
| EP | 0 246 052 | 11/1987 |
| GB | 2 176 766 | 1/1987 |
| WO | 00/03944 | 1/2000 |

* cited by examiner

*Primary Examiner*—Frederick C. Nicolas
(74) *Attorney, Agent, or Firm*—Young & Thompson

(57) ABSTRACT

A drink dispenser assembly (1, 25) includes a dispenser device (2) provided with a dispensing head (18, 29) for accommodating a dispensing line (17, 28), and a container (7, 27) containing drink, in particular carbonated drink, connected during use to the dispensing line (17, 28) which has a coupling element at an outlet end for connection to the dispensing head (18, 29). The drink dispenser assembly includes a shut-off valve (19, 32) that can be closed when placing the outlet end of the dispensing line (17, 28) into the dispensing head (18, 29) and, respectively, removing the outlet end of the dispensing line (17, 28) from the dispensing head (18, 29).

13 Claims, 11 Drawing Sheets

DRINK DISPENSER ASSEMBLY AND CONTAINER FOR DRINK AND DRINK DISPENSING LINE

This application is a division of co-pending application Ser. No. 10/296,986, filed on May 30, 2003, application Ser. No. 10/296,986 is the national phase of PCT International Application No. PCT/NL01/00423 filed on May 31, 2001 under 35 U.S.C. § 371. The entire contents of each of the above-identified applications are hereby incorporated by reference.

The invention relates to a drink dispenser assembly comprising: a dispenser device provided with a dispensing head for accommodating a dispensing line, and a container containing drink, in particular carbonated drink, connected during use to the dispensing line which has a coupling element at an outlet end for connection to the dispensing head.

A drink dispenser assembly of this type is disclosed in PCT/NL 99/00454. The known dispenser device comprises a chill chamber in which a pack containing carbonated drink, such as beer, can be placed. The pack containing carbonated drink comprises an outer container made of plastic and an inner, flexible bag with the carbonated drink therein. The flexible bag is connected via a filling and dispensing head to the neck of the outer container. The dispensing head is provided with a first, relatively broad fill channel to which a filling head of a fill line can be connected in order to fill the flexible bag. After filling and removing the filling head from the fill line, the fill channel of the filling and dispensing head is closed by a spring-loaded valve. A second, relatively narrow dispensing channel of the filling and dispensing head is connected to a flexible hose that extends at right angles to the longitudinal direction of the container. Before the container is placed in the chill chamber of the drink dispenser device, the dispensing channel is also closed by a spring-loaded valve. A plastic outlet component at right angles that is provided with a plate displaying a make is fixed to the end of the flexible hose, which outlet component can be placed in a receiver component in the dispensing head of the drink dispenser device. The dispensing head comprises two hingeable parts, which delimit a feed-through channel for the flexible hose, and a shut-off valve connected to a tap handle. The shut-off valve comprises a spring-loaded clamping mechanism that by operation of the tap handle is able to squeeze shut the flexible hose in the feed-through channel and is able to release it.

After the flexible hose has been placed in the feed-through channel the dispensing head is closed and the handle is placed in the closed position. A cover on the dispenser device can then be closed and pressure means, such as a compressor, can be connected to the container to feed a pressure medium into the space between the wall of the outer container and the flexible bag. On closing the cover of the chill chamber in the dispenser device, the dispensing channel of the filling and dispensing head is opened, so that the contents of the flexible bag are drive into the flexible hose. The flexible hose is released by opening the top handle and assumes its free, undeformed cross-section and the carbonated drink is dispensed from the dispensing head under pressure. The known dispenser device is also provided with a cooler, such as a Peltier element, for cooling the drink.

The known device has the disadvantage that controlled dispensing through the flexible hose is possible to only a limited extent and that dispensing is dependent on the flexible characteristics of the hose. If the drink is carbonated drink, such as beer, this can lead to undesired frothing.

If the tap handle is not closed when the container containing drink is placed in the dispenser device, undesired dispensing of drink can take place with the known dispenser device. Furthermore, drink will also be able to leak from the dispensing line when the empty container is removed from the dispenser device. The dispensing head and other components of the dispensing device can be soiled as a result. Consequently the known device has to be cleaned relatively frequently. Moreover, as a result of the contamination the life of drink can be shortened.

Finally, after dispensing a quantity of drink, after closing the tap handle drink can still leak for a prolonged period from that part of the flexible hose that is located downstream of the shut-off valve.

One aim of the invention is to provide a drink dispenser assembly, as well as a container and dispensing line of the abovementioned type, with which these problems are solved.

A further aim of the invention is to provide a drink dispenser assembly that requires very little maintenance, requires little cleaning and provides a hygienic environment with a relatively long life for the drink.

To this end the drink dispenser assembly to the invention is characterised in that the coupling element comprises a shut-off valve that can be closed when placing the outlet end of the dispensing line into the dispensing head and, respectively, removing the outlet end of the dispensing line from the dispensing head.

Because the coupling element of the dispensing line, which can be placed in an unambiguous position in the dispensing head, is provided with a shut-off valve, controlled dispensing of the drink can be obtained. Especially if the drink is carbonated drink, such as beer, undesired frothing can be counteracted by this means. Furthermore, in contrast to the known flexible dispensing line, the flow characteristics through the dispensing line according to the invention can be adjusted by sizing the dimensions and the stroke of the shut-off valve. Tap feel, the flow rate and the type of jet of drink can be accurately adjusted by this means.

The drink dispenser device, the container and the dispensing line according to the present invention are suitable for dispensing all types of drink, but are particularly suitable for dispensing carbonated drink, such as beer. In the illustrative embodiments given below reference is made to carbonated drinks by way of example.

Furthermore, the shut-off valve can be closed when placing the pack containing carbonated drink in the dispenser device, so that leakage of carbonated drink is prevented even if the tap handle is in the open position. The shut-off valve is closed when the empty or partially empty pack is removed from the dispenser device and leakage of drink, present in the flexible dispensing line, from the dispensing line is prevented. As a result a favourable microbiological environment is maintained and the need for frequent cleaning of the dispenser device decreases. Finally, as a result of the use of the shut-off valve in the dispensing line a relatively simple filling and dispensing head can suffice for the container containing carbonated drink, which filling and dispensing head is provided with a dispensing channel with a simple closure, for example a breakable seal that is opened after placing the pack in the dispenser device and can no longer be resealed.

The dispensing line can be of rigid construction, but can also be telescopic or at least partially of flexible construction. The latter is preferred since this facilitates the positioning of the shut-off valve in the dispensing head. It is preferable to make the dispensing line of flexible plastic so that this constitutes a disposable or semi-disposable line that is thrown away after it has been used once or a number of times.

The dispensing line can be permanently connected to the container containing carbonated drink, but can also be provided with a coupling for detachable connection to the container.

The shut-off valve can be a normally closed shut-off valve, such as a slit valve in the flexible hose, that can be opened by compression by the tap handle, a separate plastic shut-off valve with a closed equilibrium position, a spring-loaded (ball) valve or an electromagnetic valve. The shut-off valve can, however, also comprise a tap or valve known per se and can be provided with an opening element by means of which it can be opened and closed by a user after it has been placed in the dispensing head.

Preferably, however, the shut-off valve is not provided with an operating element for the user, but the dispensing head comprises an operating element, joined to the handle or knob, by means of which the shut-off valve can be detachably connected, so that the shut-off valve itself can have small dimensions. This has the advantage that the shut-off valve is not only of lightweight construction and has a small number of components, so that it can easily be made as a disposable item for once-only use, but that it can also easily be accommodated, stored and transported in the pack, it being possible, for example, to accommodate the dispensing line in the coiled state on top of or beneath the base of the pack containing carbonated drink.

Furthermore, as a result of the relatively small dimensions of the shut-off valve, which preferably has a cylindrical cross-section which is not much larger that the external diameter of the dispensing line, said shut-off valve can easily be fed through an—optionally cooled—guide tube of a drink dispenser device of a type that is described in Patent Application number 1015359 bearing the title "Tap device and container therefor, as well as method for the production thereof", which was filed on 31 May 2000 in the name of the Applicant. In such a dispenser assembly with guide tube the compartment for accommodating the pack containing carbonated drink comprises a refrigerator located beneath a bar, the flexible dispensing line extending from the refrigerator to the pump, which carries the dispensing head. When connecting a new pack and associated dispensing line, which in this case can have a length of 1 metre or more, the shut-off valve at the end of the flexible dispensing line can easily be pushed through the guide tube to the dispensing head.

The operating element of the dispensing head can comprise a fork in which the shut-off valve can be fitted. The shut-off valve is provided with coupling means, for example in the form of a flange or a groove, which can be detachably connected to the fork.

In one embodiment the shut-off valve comprises a first sleeve and a second sleeve, which is concentric with respect to the first sleeve, which first sleeve is provided with an inlet to an upstream part of the dispensing line and an outlet, the second sleeve being provided with an inlet which interacts with the outlet of the first sleeve and with an outlet coupling means being arranged on one of the sleeves which can be moved by the coupling means between a flow position, in which the outlet of the first sleeve is in fluid communication with the inlet of the second sleeve, and a shut-off position in which the outlet of the first sleeve is closed off by the second sleeve.

The dispensing line is opened and closed by relative rotation, translation, or a combination thereof, of the sleeves by the operating element of the shut-off valve. A simple shut-off valve that is reliable in operation comprises sleeves that can be moved with respect to one another in the direction of the dispensing line. With such an "in line" shut-off valve the pressure of the carbonated drink can provide an additional closing force, a simple operating element can be used in the dispensing head for an accurately adjustable stroke, which can easily be adjusted for a tap handle, and the size of the shut-off valve can remain small.

By using a "can" shut-off valve that can be opened and closed in the axial direction of the dispensing line, which shut-off valve is pushed into its closed position by the pressure of the carbonated drink, a simple, compact shut-off valve that is reliable in operation is formed which is suitable for once-only use and which can easily be fitted in the dispensing head and can easily be removed therefrom.

The dispensing head can have a base section into which the shut-off valve can be placed. The shut-off valve can be provided with a protective cap which interacts with the base section, such that the shut-off valve is enclosed between the base section and the protective cap and is not accessible to the user during use.

The dispensing head is preferably divided into two halves which are hingeable with respect to one another and which delimit a feed-through channel in which the dispensing line can be placed.

Preferably, the hingeable halves are provided with a locking mechanism that can be released only when the shut-off valve is closed.

The outlet end of the dispensing line that is located downstream of the shut-off valve can consist of a relatively rigid plastic section with a peripheral groove or flange which interacts with a complementary flange or groove in the dispensing head for accurate positioning of the end of the dispensing line. If a cooling medium is fed through the dispensing head, as described in Patent Application no. 1015359 filed on 31 May 2000 in the name of the Applicant, the dispensing head is closed off by the dispensing line such that it is at least partially fluid-tight at the point where the dispensing line emerges from the dispensing head.

The outlet end of the dispensing line can be provided with a plate with, for example, the tradename of the drink thereon. This plate can be fitted in a chamber in the dispensing head, which chamber is provided with a window through which the plate is visible to the user. By this means the content of the pack containing carbonated drink that has been placed in the dispenser device can easily be established.

Finally, in one embodiment the shut-off valve is provided with a vent which is closed when the shut-off valve is open and which connects the outlet end of the shut-off valve to the environment when the shut-off valve is closed. By this means, a vacuum arising after dispensing drink and then closing the shut-off valve is released and all drink downstream of the closed shut-off valve will be dispensed rapidly from the outlet end of the dispensing line without significant subsequent dripping.

A few embodiments of a drink dispenser assembly according to the invention will be explained in more detail with reference to the appended, non-limiting drawing, in which:

FIG. 1 shows a diagrammatic cross-section of a first embodiment of a drink dispenser assembly according to the invention, suitable in particular for use by the consumer at home, FIG. 2 shows a cross-section of a second embodiment of a drink dispenser assembly according to the invention, suitable in particular for use in catering establishments, FIGS. 3, 4 and 5 show, respectively, a longitudinal section, a cross-section and an exploded view of a dispensing head and dispensing line of the drink dispenser assembly according to FIG. 2, FIGS. 6*a* and 6*b* show a longitudinal section of, respectively, the outlet end of the dispensing line and of the shut-off valve in the closed position, FIGS. 7*a* and 7*b* show a longitudinal section of, respectively, the outlet end of the dispensing line and of the shut-off valve in the flow position, FIGS. 8*a*–8*d* show longitudinal section of a number of alternative embodiments of the shut-off valve according to the invention;

Figure 1:
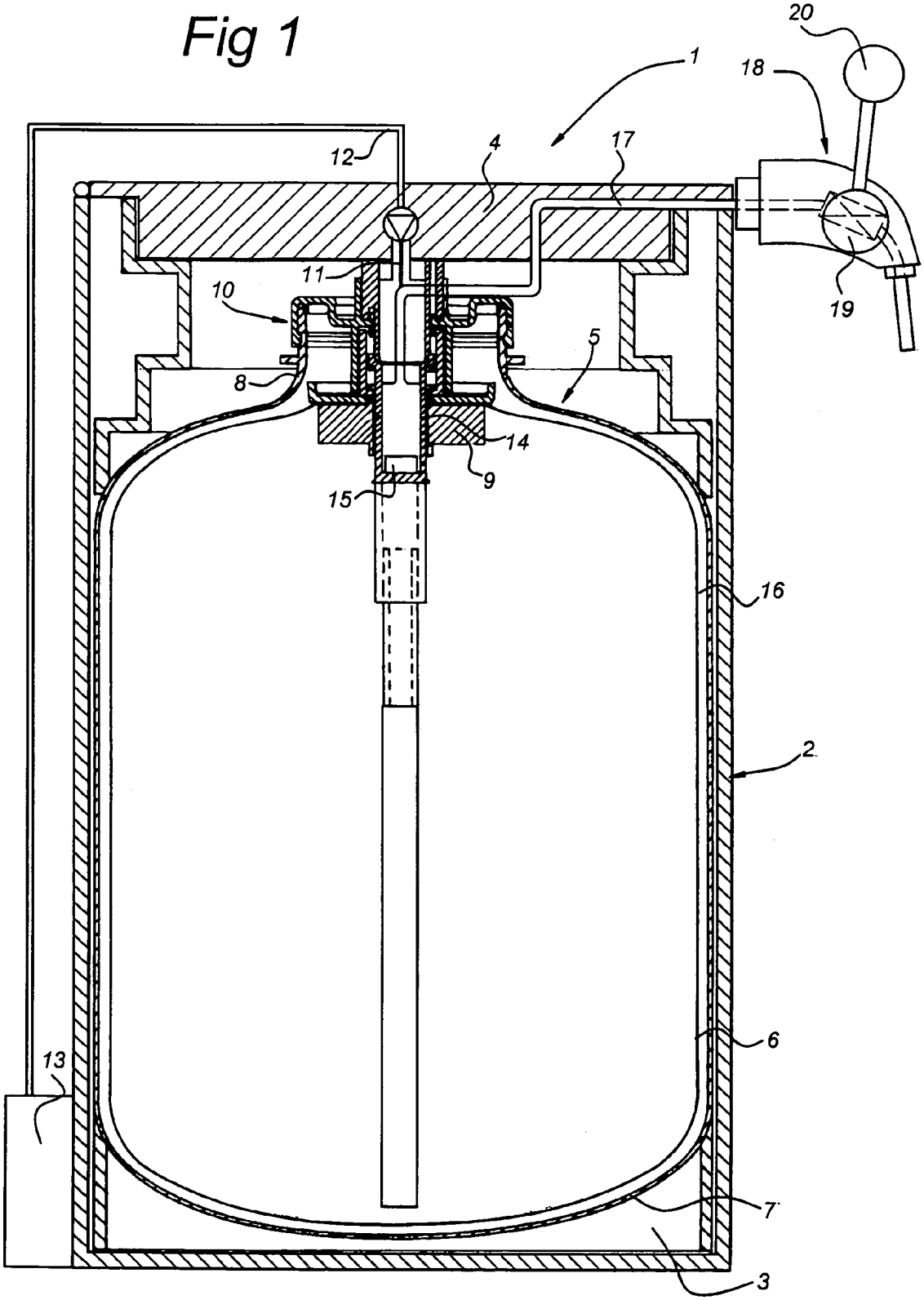

FIG. 1 shows a drink dispenser assembly 1 provided with dispenser device 2 with a chill chamber 3 that can be closed off by means of a cover 4. A pack 5 containing carbonated drink is placed in the chill chamber 3. In the embodiments described below the carbonated drink is beer that is contained in a flexible bag 6 of the pack 5 under an excess pressure of between 0 and 3 bar, for example 1 to 1.5 bar (the equilibrium pressure of $CO_2$ above beer). The pack can, however, also contain other carbonated drinks, such as non-alcoholic drinks, under pressure which in general are between 0 and 5 bar excess pressure.

The flexible bag 6 is accommodated in an outer, rigid container 7 of the pack 5 and close to a neck is fixed to a flat lip 9 of a filling and dispensing head 10 so as to provide a seal. The filling and dispensing head 10 has an air channel 11 that can be connected to a pressure line 12 in the cover 4, which pressure line is connected to a compressor 13. Instead of a compressor it is also possible to use a different pressure medium, such as a pre-compressed gas, for example compressed air or pressurised $CO_2$ that is supplied from a separate cylinder. On closing the cover 4, a spring-loaded valve 14 of the filling and dispensing head 10 is moved downwards so that an outlet 15 is exposed and an air channel in the head 10 to the space 16 between the flexible bag 6 and the rigid container 7 is opened, which air channel is in communication with the pressure line 12.

A flexible dispensing line 17 is connected to the filling and dispensing head 10 and when the pack 5 is placed in the chill chamber 3 is connected to a dispensing head 18. The dispensing line 17 has a shut-off valve 19 close to an outlet end, which shut-off valve 19 is removably fitted in the dispensing head 18 and is in a normally closed position. When the pack 5 is placed in the dispenser device 2 and the cover 3 is closed, as a result of which the compressor 13 is activated, the shut-off valve 19 is closed and, as a consequence of the pressure built up in the gap 16 by the compressor 13, the beer is driven out of the flexible bag into the flexible line 17, against the shut-off valve 19. By operating a handle 20, the shut-off valve 19, which is an integral part of the dispersing line 17, can be opened and the beer can be tapped from the bag 6. When the pack 5 has been emptied, or if another drink pack is placed in the dispenser device when the pack is still partly full, the container 7 and the flexible dispensing line 17 with the closed shut-off valve 19, which are connected thereto, are removed from the chill chamber 3. The container 7 of the empty pack 5, which, for example, can be made of plastic such as PET or ABS, can be re-used, whilst the flexible bag 6, the filling and dispensing head 10 and the flexible line 17 with the shut-off valve 19 can have been made for once-only use and thrown away or recycled after use. For further details of the drink dispenser device 2 reference is made to International Patent Application PCT/NL 99/00454 in the name, of the Applicant, the contents of which are incorporated herein by reference.

Figure 2:
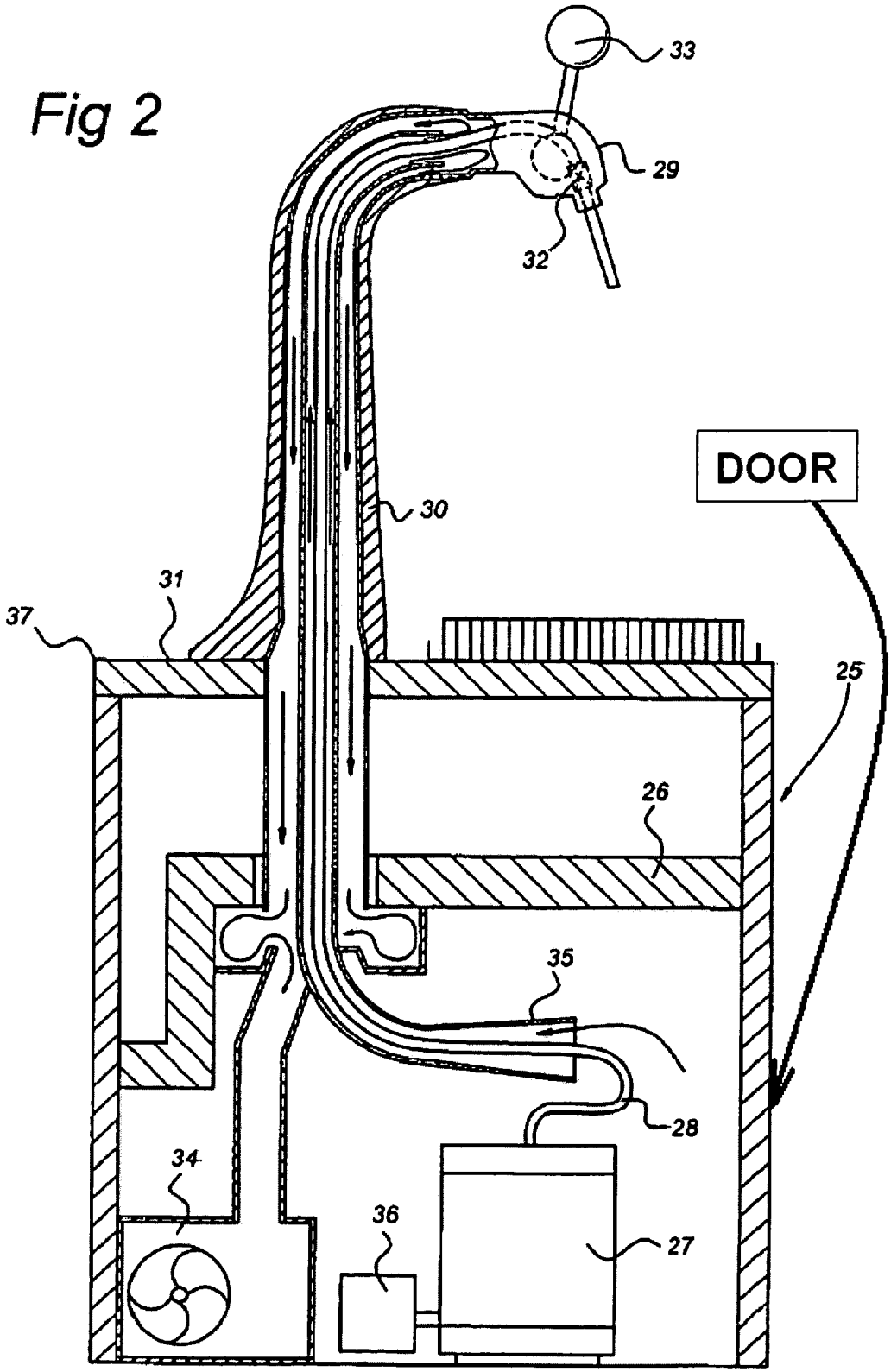

FIG. 2 shows an embodiment of drink dispenser device 25 that is suitable in particular for use in catering establishments. The dispenser device 25 comprises a chill compartment, or refrigerator, 26 with a container 27 containing a carbonated drink therein. The container 27 can comprise a double-walled pack with a rigid outer casing with a flexible bag therein, as shown in FIG. 1, but can also comprise a metal container, such as a stainless steel beer keg known per se. The capacity of the container 27 can vary from a few litres up to 50 litres or more. A compressor $CO_2$ cartridge 36 is connected to the container 27. Furthermore, instead of a compressor or $CO_2$ cartridge, a cartridge containing carbon and $CO_2$ can be placed in the container 27 to generate the desired pressure, as described in International Patent Application PCT/NL/99/00144. The container 27 is connected via a flexible plastic dispensing line 28 to a dispensing head 29. The dispensing head 29 is a part of a beer pull 30 that is fixed to the counter of a bar 31. A shut-off valve 32 according to the present invention is fitted on the outlet end of the flexible line 28, which shut-off valve 32 can be opened and closed by means of handle 33 at the end of the beerpull 30.

A cooling element, that is not indicated in more detail, is accommodated inside the refrigerator 26, which cooling element cools the air in the refrigerator down to, for example 5° C.–10° C. By means of a fan 34, warm air from the hollow beerpull 30 is drawn back into the refrigerator 26. Via a guide tube 35, in which the flexible dispensing line 28 is accommodated and which opens into the dispensing head 29, cold air is fed from the refrigerator 26 through the guide tube 35 over the dispensing line 28 as a result of the vacuum thus produced in the dispensing head 29. The drink is cooled to, for example 8° C. by this means. The device described above is described in more detail in Netherlands Patent Application no. 1015359 filed on 31 May 2000 in the name of the applicant and entitled "Tap device and container therefor, as well as method for the production thereof".

Figure 3:
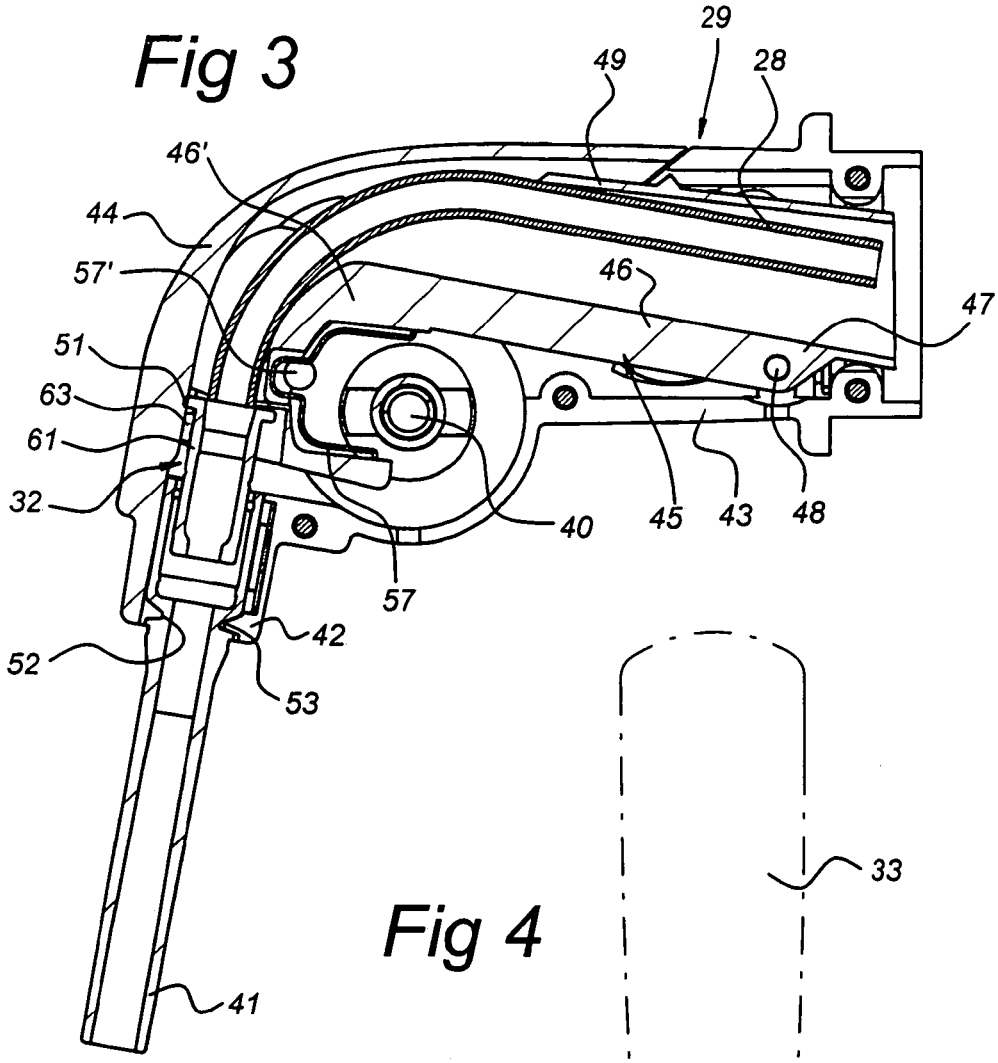

FIG. 3 shows a longitudinal section of dispensing head 29 according to FIG. 2. The handle 33 is joined to the housing 43 such that it can rotate about a shaft 40 and engages via a spring 57 and projection 57' on operating element 45 for opening and closing the shut-off valve 32. The free stroke of the handle 33 can be adjusted by positioning projection 57' with respect to the control element 45. In the position shown in FIG. 3 the projection 57' engages directly on the operating element 45, so that the shut-off valve 32 is opened and closed by a small movement of the handle 33. Exchanging the projection 57' for a projection 57' located further to the right compared with the projection in FIG. 3 will allow the handle to make a greater free stroke before engaging on the operating element 45. By this means, complete opening and closing of shut-off valve 32 can be obtained with a large stroke, such as 90°, of the handle 33. The stroke of the handle 33 can be adjusted between the relatively small stoke (for example 10°) as shown in FIG. 3, and a relatively large stroke, such as 90°, by simply changing the projection 57'.

By means of the spring 57 a certain movement of the handle 33 is possible without this leading to movement of the operating element 45 and the play is eliminated from the rotation of the handle shaft 40.

An outlet and 41 of the flexible dispensing line 28, which is guided along a curved path by the dispensing head 29, is enclosed in the seat 42 of the dispensing head. The outlet end 41, made of rigid plastic, is provided with a peripheral groove 52 into which a rim 53 of the seat 42 of the dispensing head 29 drops to provide rigid enclosure of the outlet end 41.

The dispensing head 29 comprises a fixed lower section of the housing 43 to which a cover 44 is hingeably joined between a closed position and an open position, in which the outlet end 41 and the shut-off valve 32 of the line 28 can be placed in the dispensing head 29.

The operating element 45 comprises an essentially horizontal arm 46 that is joined by a first end to a pin 48 such that it can pivot. The flexible dispensing line 28 is placed via a guide 49, attached to the top of the operating element 45, in a curved path in contact with a curved end 46' of the operating element 45.

Coupling means of the shut-off valve 32, which for example, are formed by a flange 51 on a slideable sleeve 61, are connected to a coupling element at the end of the curved end 46' of the arm 46. The coupling element can suitably be constructed as a fork 63 which engages behind the flange of the shut-off valve 32.

Figure 4:
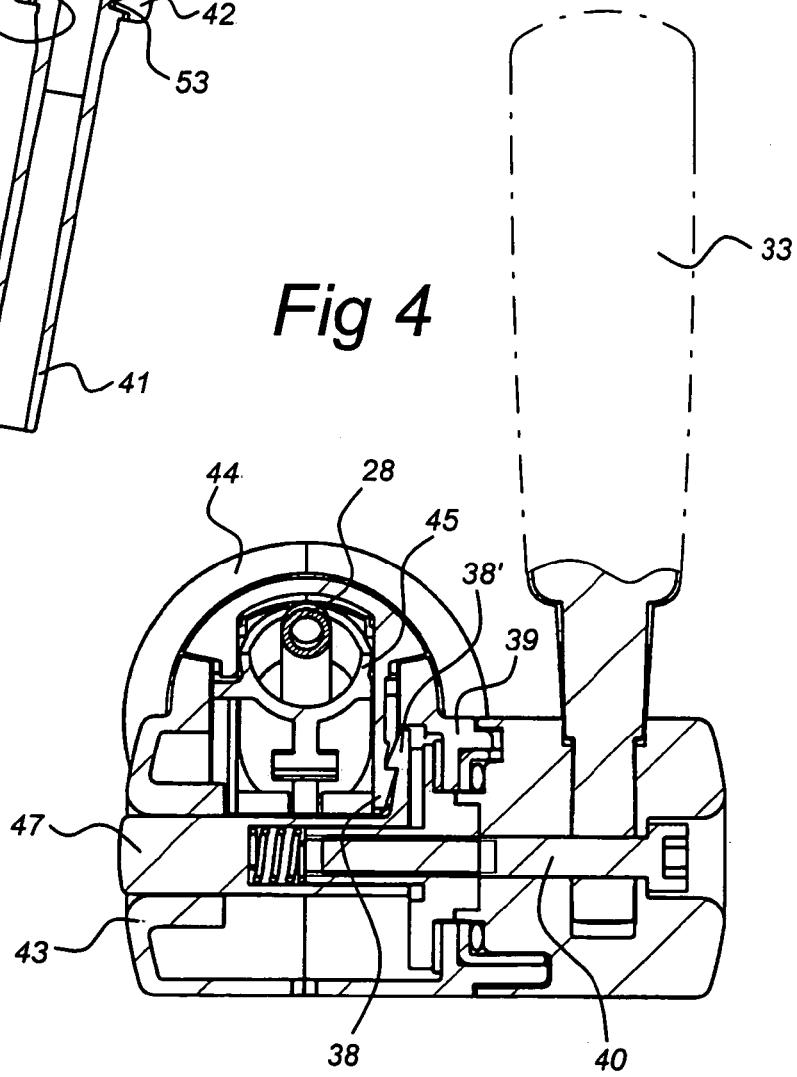

FIG. 4 shows the shaft 40 fixed to the handle 33 for moving the operating element 45. The shaft 40 is provided at one end with a spring pawl 47 which has a tooth 38' running at right angles to the shaft 40 at its end. The hingeable cover 44 of the dispensing head 29 has a complementary tooth 38 which engages with the tooth of the spring pawl 47. When the handle 33 is in the upright position, in which the shut-off valve 32 is closed, a releasing cam 39, which likewise is connected to the shaft 40, is positioned such that spring pawl 47 can be depressed, the tooth 38' dropping into the accommodating cavity in the releasing cam 39. This position is shown in FIG. 4, so that when shut-off valve 32 is closed and handle 33 is in the upright position the cover 44 of the lower section of the housing 43 can be released and is able to hinge open about hinge pin 60.

Figure 5:
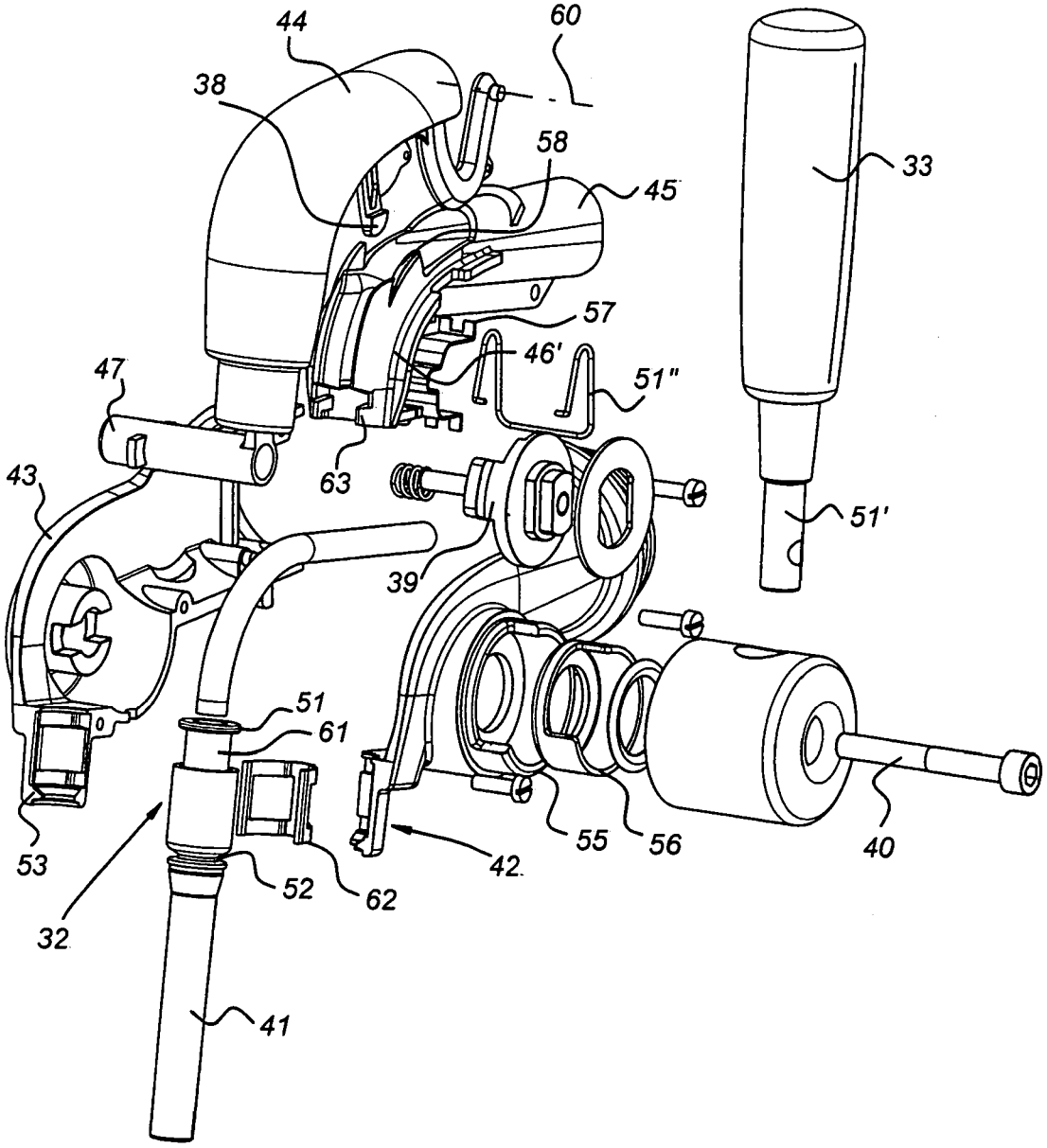

As can be seen from FIG. 5, the shank 51' of handle 33 is accommodated within a recess in the wall of two concentric annular sleeves 55, 56. By rotation of the sleeve 56 about its axis with respect to the sleeve 55, or by completely omitting sleeve 56, it is possible to adjust the stroke of the handle 33 between, for example, 90° a 10° by, respectively, allowing the openings in the walls of the rings 55, 56 to be in line or moving them into a mutually offset position.

A stop 58 has been formed on the top of the operating element 45, against which stop the shut-off valve 32 comes into contact, on introducing the dispensing line 28 into the dispensing head 29 via the guide tube 35 shown in FIG. 2, and pushing the shut-off valve 32 through too far to beyond the dispensing head 29 is prevented.

Furthermore, FIG. 5 shows a spring element 51" that is connected to the cover 44 in order to move the cover into the upright position on operating the spring pawl 47 and unlocking the cover 44.

It can clearly be seen from FIG. 5 that the end 46' of the operating element 45 is in the shape of a curved saddle that guides the flexible line 28 without kinking or sharp bends from a horizontal into an essentially vertical position, which saddle terminates in a fork 63 into which the flange 51 of the internal sleeve 61 of the shut-off valve 32 can be placed. A separate clamping spring 62 is fitted as a separate component in the seat 42 in order to position the shut-off valve 32 such that it is clamped with respect to the seat 42 when the cover is open, so that the cover 44 can be closed. With this arrangement the rim 53 on the seat 42 and the peripheral groove 52 of the outlet end 41 form a relatively air-tight closure, as a result of which drawing in of air past the outlet end 41 into the cooled beerpull 30 is counteracted.

The closed shut-off valve 32 prevents beer from leaking into the guide tube 35 when introducing and when withdrawing the dispensing line 28, which as a result of its rigidity is able to push the shut-off valve 32 and the outlet end 41 through the guide tube 35. After all, the inner sleeve 61 is placed in its position when introducing shut-off valve 32 into the fork 63 or removing it from the fork 63, so that the shut-off valve 32 is closed. As a result of the use of the dispensing head 29 in cooperation with the flexible dispensing hose 28 which is provided with shut-off valve 32 close to the outlet end 41 rapid and easy positioning of the dispensing line 28 can take place so that an empty vessel of carbonated drink can easily be replaced by a full vessel. Because the entire dispensing line 28 is also replaced during this operation, frequent cleaning of the dispensing line is no longer required, which has the effect of saving a great deal of time and costs, especially when tapping beer.

Figure 6A:
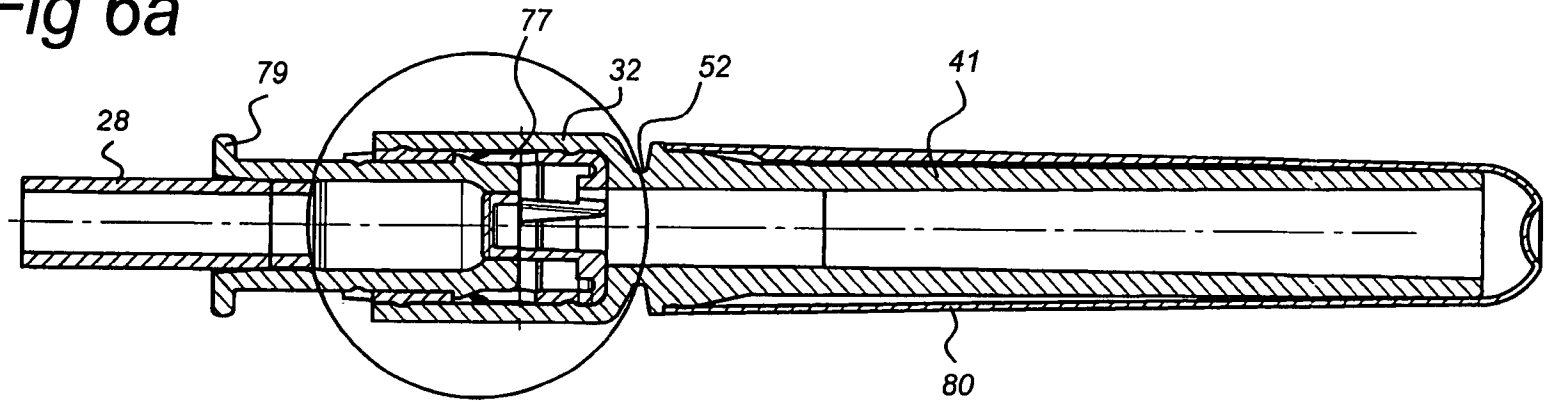

FIG. 6*a* shows the plastic outlet end 41 of the flexible dispensing hose 28, provided with the shut-off valve 32 according to the present invention. As can be seen from FIG. 6*b*, the outlet end 41 comprises an external sleeve 70 in which an interior closing projection 71 is accommodated. The closing projection 71 is provided with lateral passageways 72 through which the carbonated drink is able to pass from an upstream channel section 73 of the shut-off valve to a downstream outlet section 74. An internal sleeve 75, to which the flexible dispensing line 28 is welded, is accommodated in the outer sleeve 70 such that it is slideable around the projection 71. The outlet 73' of the inner sleeve 75 has a sealing wall 76 with a height corresponding to the height of the projection 71.

Figure 6B:
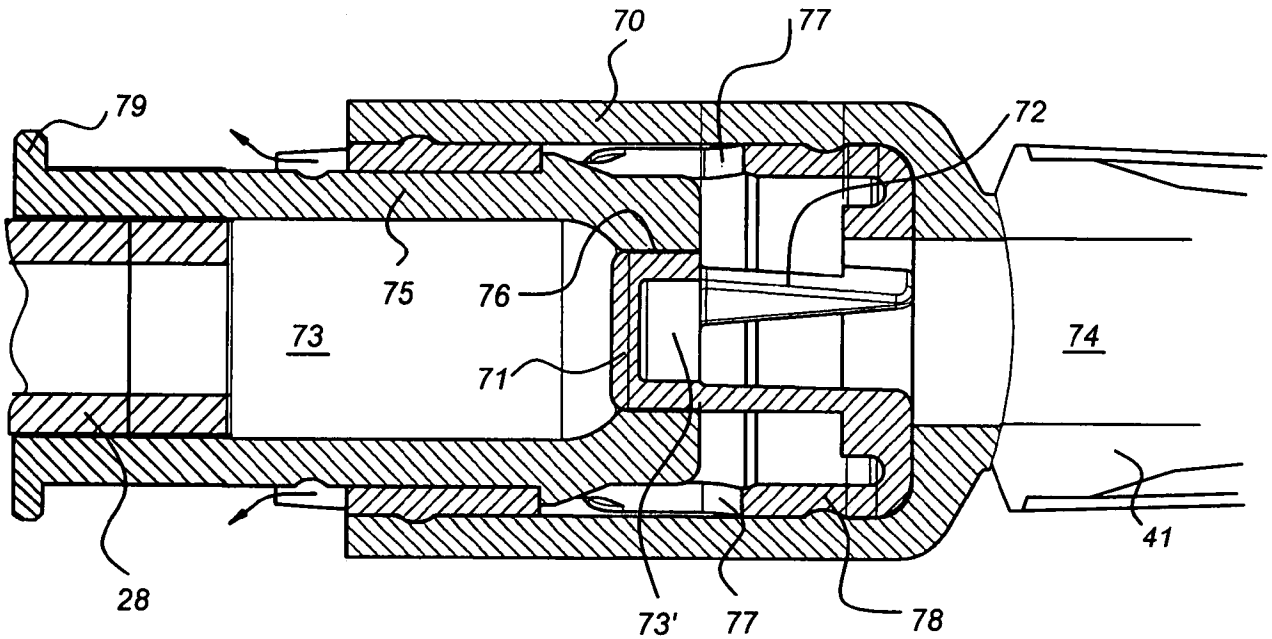

In the position shown in FIG. 6*b* the sealing wall 76 of the outlet 73' of the inner sleeve 75 is in contact with the projection 71 such that a seal is produced. In the shut-off position shown in FIG. 6*b* openings 77 in the wall of the intermediate sleeve 78, which carries the projection 71, are exposed so that the downstream outlet channel 74 is vented via the openings 77 around the top rim of the outer sleeve 70 (see the arrows indicated diagrammatically) so that a vacuum is not able to build up in the outlet channel 74. When a shut-off valve 32 is closed, such a vacuum gives rise to long-term after-leakage of the carbonated drink from the outlet channel 74, which is undesirable. This is prevented by the vent openings 77 according to the invention. In the position shown, the sealing effect of the sleeve 75 increased by the pressure of the carbonated drink, which presses the sleeve 75 into the closed position.

A sealing cap 80 with a rounded point is fitted on the outlet end 41 to prevent the shut-off valve 32 becoming soiled when inserting the dispensing line 28 into the dispensing head 29 and to achieve smoother guiding of the shut-off valve 32 through the guide tube 35. The protective cap 80 is removed from the outlet end 41 before the outlet end 41 is placed in the seat 42.

Figure 7A:
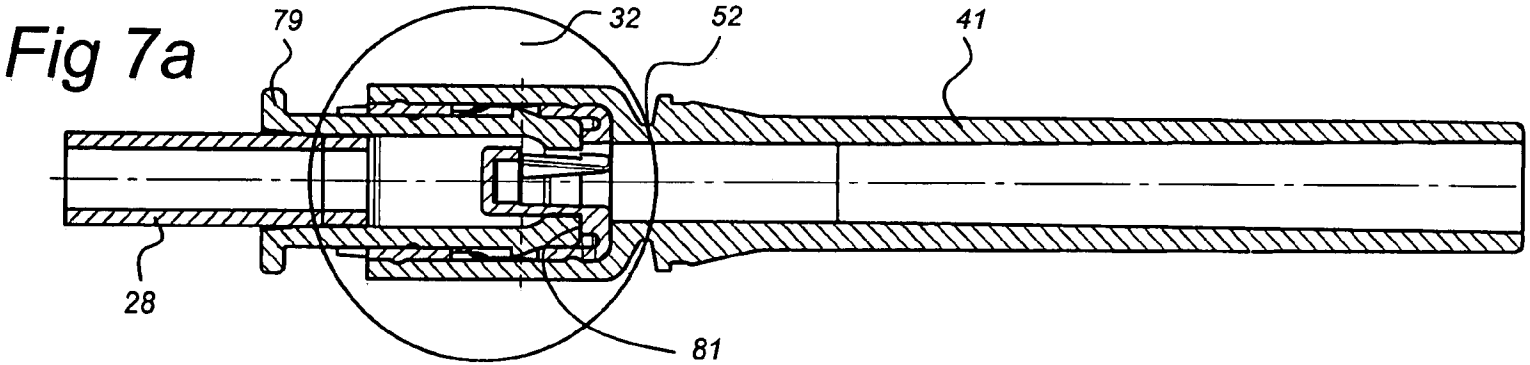
Figure 7B:
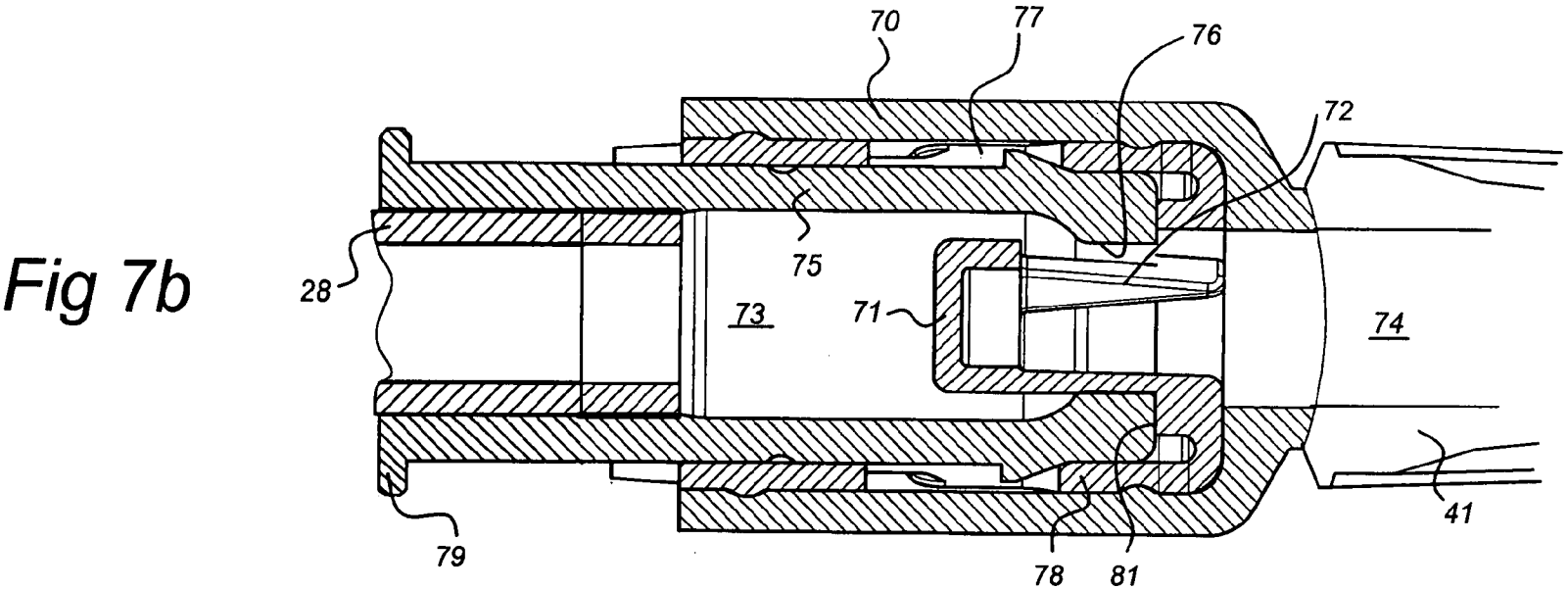

FIGS. 7*a* and 7*b* show the shut-off valve 32 in its open position, an end face 81 of the internal sleeve 75 being in contact with a bottom face of intermediate sleeve 78. In the position shown, the upstream channel section 73 is in fluid communication with the downstream outlet channel 74 of the shut-off valve 32. Because the front end of the sealing wall 76 of the internal sleeve 75 is in contact with the intermediate sleeve 78 such that a seal is produced, carbonated drink is prevented from being able to pass to the vent openings 77 when the shut-off valve 32 is in the open position. The height of the sealing wall 76 is sized such that the vent openings 77 are completely shut-off at the point in time when part of the wall 76 is still in contact with the projection 71 and therefore no beer is yet able to issue through the outlet 72.

The internal sleeve 75 is provided at its end with a flange 79 that can be accommodated in the fork 63 of the operating element 45. With this arrangement the external sleeve 70 is firmly clamped in the dispensing head via the peripheral groove 52 and the play for axial movement of the internal sleeve 75 by means of the flange 79 is provided by the flexible nature of the line 28 which is able to give sufficiently to make a stroke of a few millimetres, such as approximately 4 millimetres, by the internal sleeve 75 possible.

FIGS. 8*a* to 8*d* show various alternatives of the shut-off valve 32 according to the present invention, the same reference numerals as in FIGS. 6 and 7 being used for identical components.

Figure 8A:
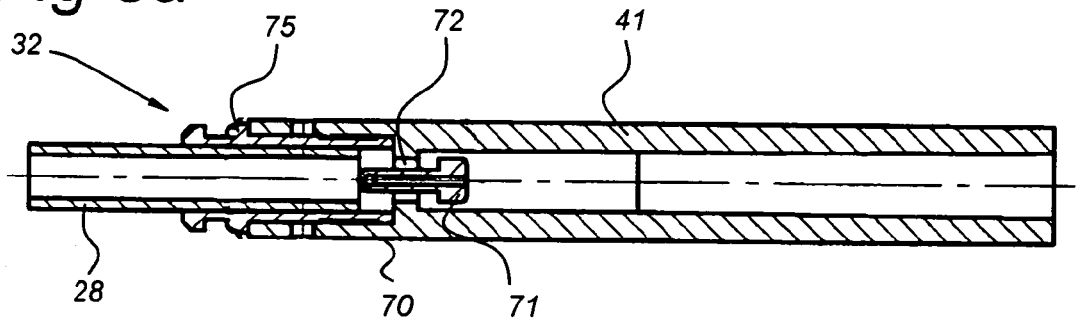

FIG. 8*a* shows an embodiment in which the outlet 72 is located in a central constriction in the external sleeve 70. The internal sleeve 75, with the flexible line 28 fixed thereto, is placed inside the external sleeve such that it can be moved and has a sealing projection 71 at its end, which sealing projection 71 can be placed into sealing contact inside the outlet 72 by drawing back the internal sleeve 75.

Figure 8B:
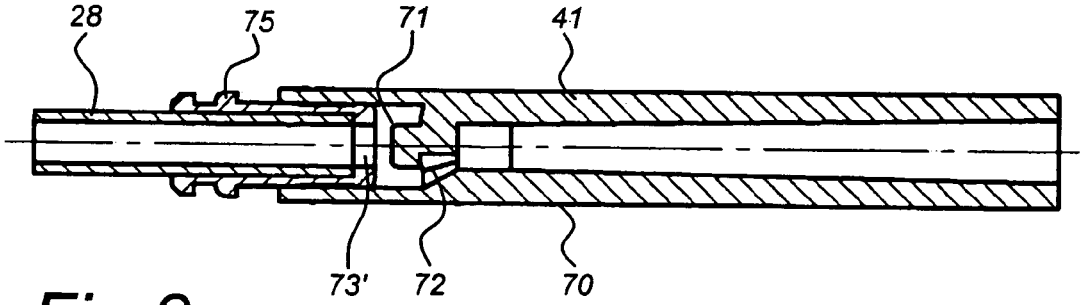

FIG. 8*b* shows an embodiment with which the external sleeve 70 is provided with a sealing projection 71 and with an outlet 72, around which projection an outlet 73' in the internal sleeve 75 can be positioned to produce a seal. With this arrangement the wall of the outlet 73' engages, such that a seal is produced, on the projection 71 that is arranged in the external sleeve 70 in a fixed position and the outlet 72 is closed off by a side wall section of the inner sleeve 75.

Figure 8C:
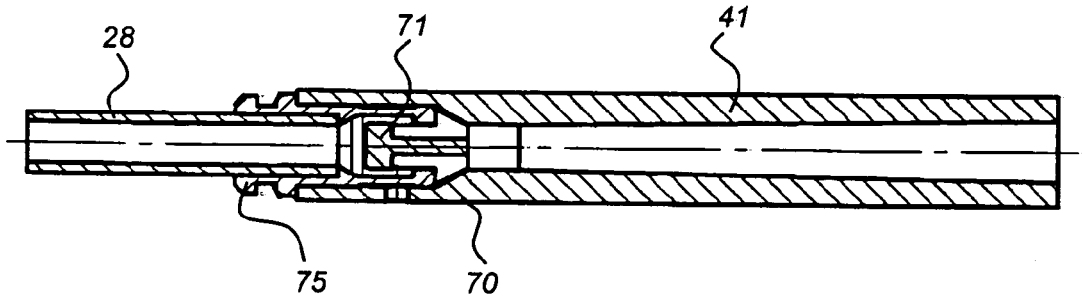

FIG. 8*c* shows an embodiment with which a projection 71 is arranged on the inside of the external sleeve 70, around which project 71 side wall sections of the internal sleeve 75 are located which extend beyond the projection 71 in the downstream direction. The front wall sections can be positioned around the projection 71 to produce a seal by drawing back the internal sleeve.

Figure 8D:
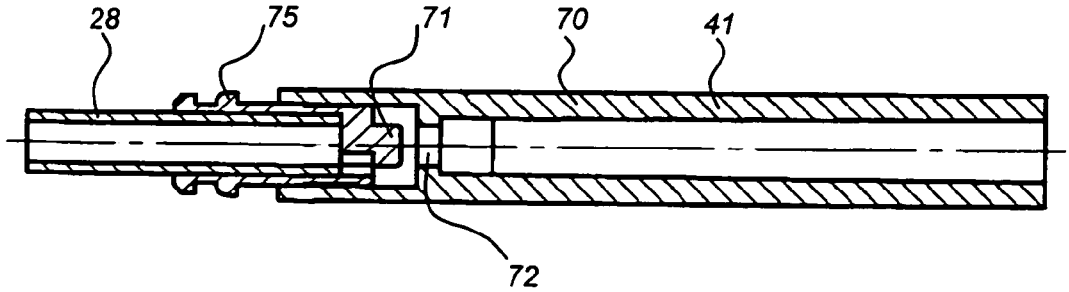

FIG. 8*d* shows an embodiment which is the mechanical reverse of the embodiment according to FIG. 8*b*, sealing projection 71 being arranged on the internal sleeve 75 and a stationary outlet 72, which can be closed off by the projection 71, being made in the external sleeve 70.

Embodiments with which the internal sleeve 75 and the external sleeve 70 are provided with inlets and outlets that can be positioned such that they close off one another or in a flow position by turning relative to one another are also possible.

Figure 9:
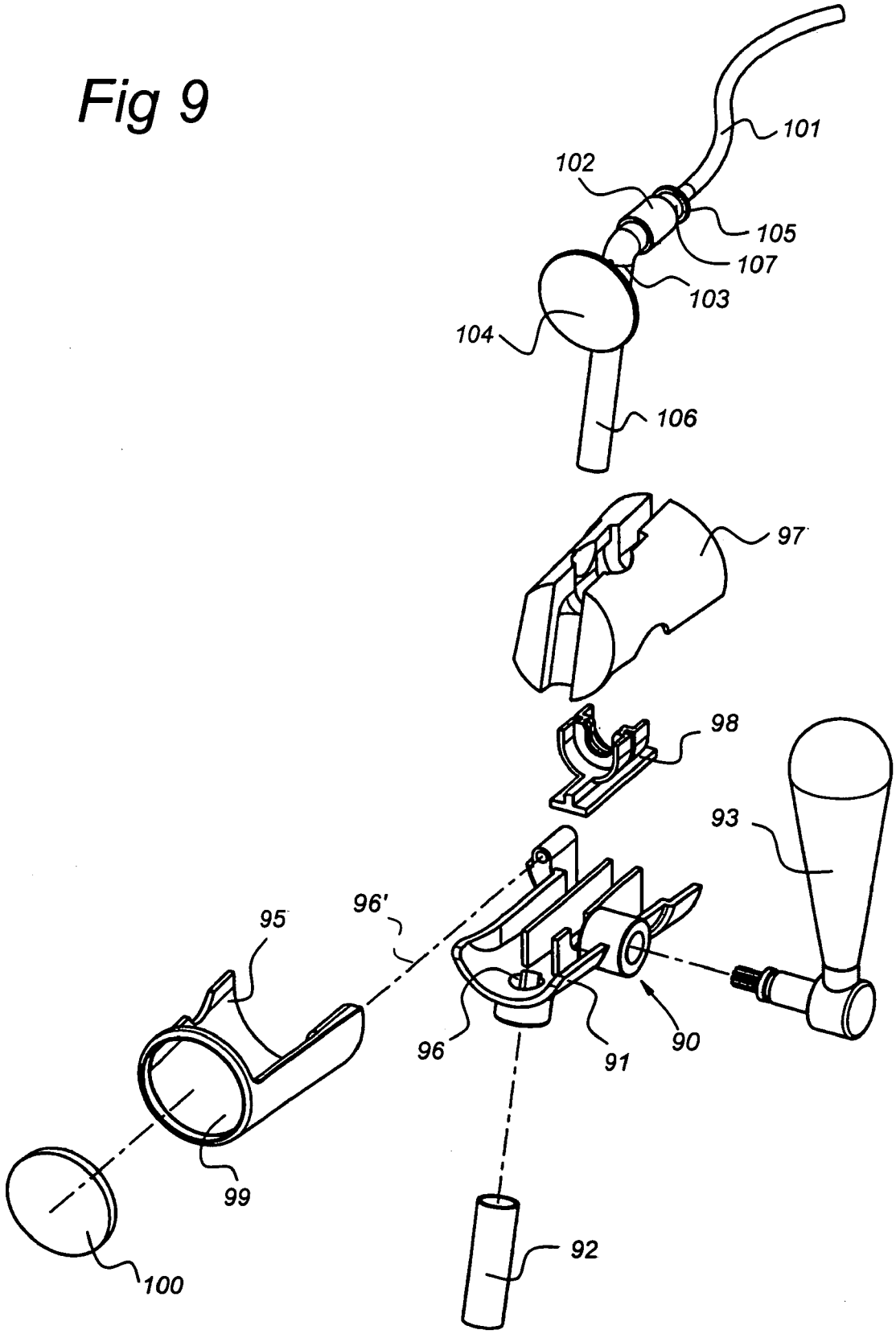
FIG. 9 and FIG. 10 show a perspective view and a cross-section of the outlet end of the dispensing line and of the dispensing head of the drink dispenser assembly according to FIG. 1 in, respectively, the disassembled state and the assembled state.
Figure 10:
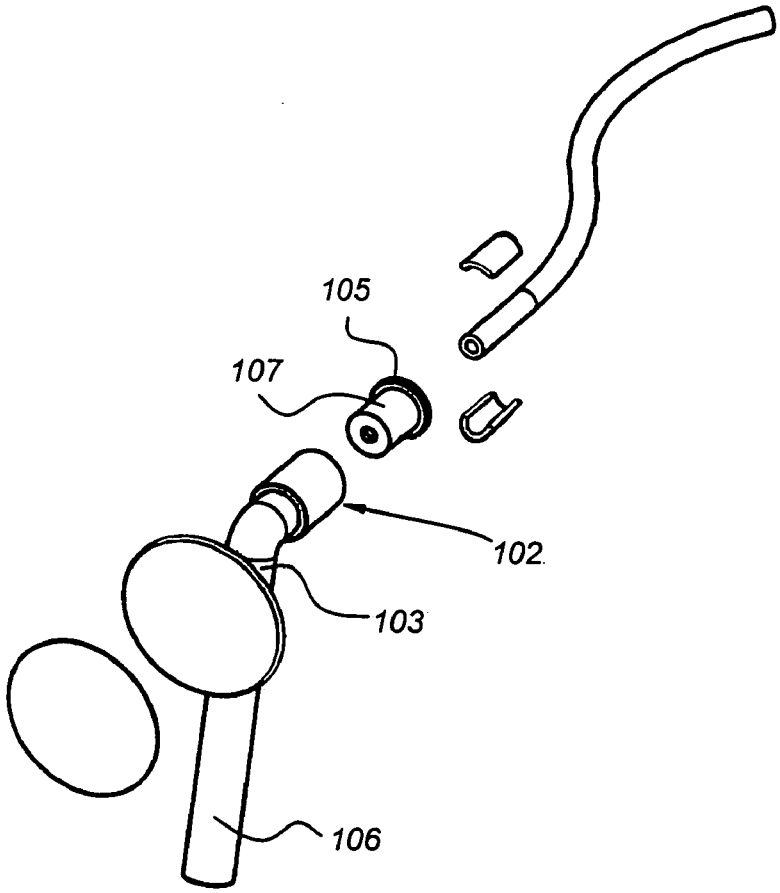
Figure 10:
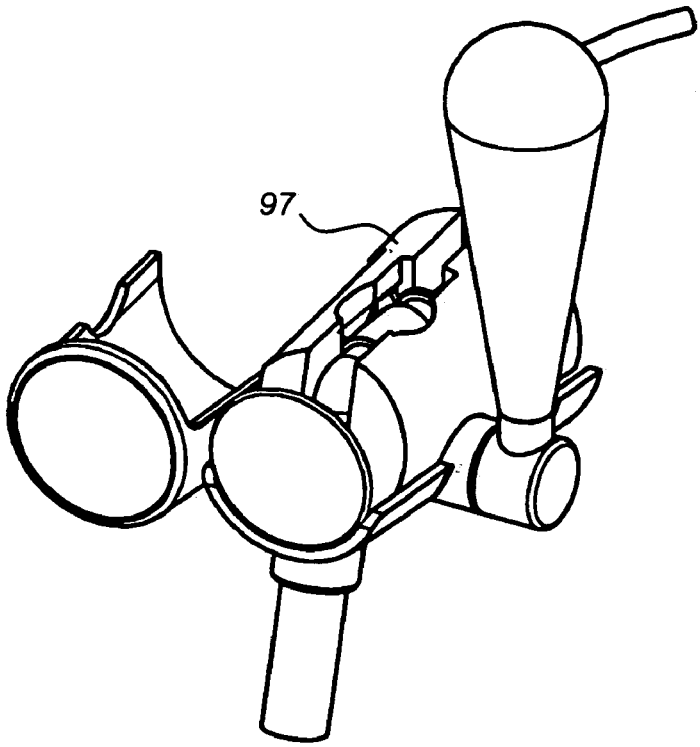

FIGS. 9 and 10 show an embodiment of a dispensing head 90 and dispensing line 101 for use in a dispenser device as shown in FIG. 1. The dispensing head 90 comprises base section 91 with the handle 93 fixed thereto. The base section 91 is provided with a bore 96 and a receptacle tube 92 for receiving a right-angle outlet end 103 of the flexible dispensing line 101. The base section 91 is also provided with a receptacle component 97 for accommodating the flexible dispensing line 101 and the shut-off valve 102 and with a control element or guide 98 that can be slid along the receptacle component 97 in the axial direction and is connected to the handle 93 for operating the shut-off valve 102 of the dispensing line 101. The guide 98 can be constructed in the same way as the fork 63 that is shown in FIG. 5 and engages on the flange 105 of the inner sleeve 107 of the shut-off valve 102 in FIG. 10.

The dispensing head 90 is furthermore provided with a top section 95 that is joined to base section 91 such that it can be hinged about a hinge pin 96'. The top section 95 comprises a chamber 99 for accommodating a plate 104 at the end of dispensing line 101. The plate 104 of a dispensing line 101 fitted in the dispensing head 90 is visible via an opening or window 100, so that the contents of the drink dispenser device can be established. The window 100 can have a curved and thus magnifying shape.

FIG. 10 shows the assembled dispensing head and the disassembled flexible dispensing line 101 with, at the end, a shut-off valve 102 of the type shown FIGS. 6*a* to 8*d*. The shut-off valve 102 is connected to the outlet end 103 that is at right angles to the shut-off valve 102 and is fitted in the bore 96 of the dispensing head 90. Furthermore, the plate 104 at the outlet end 103 is provided with visual symbols in order to be able to establish the type of carbonated drink when the plate 104 is fitted in the chamber 99 of the dispensing head. By this means an accurately defined position of the outlet end 106 is guaranteed after the top section 95 has been hinged shut, so that favourable tapping characteristics are obtained.

Figure 11:
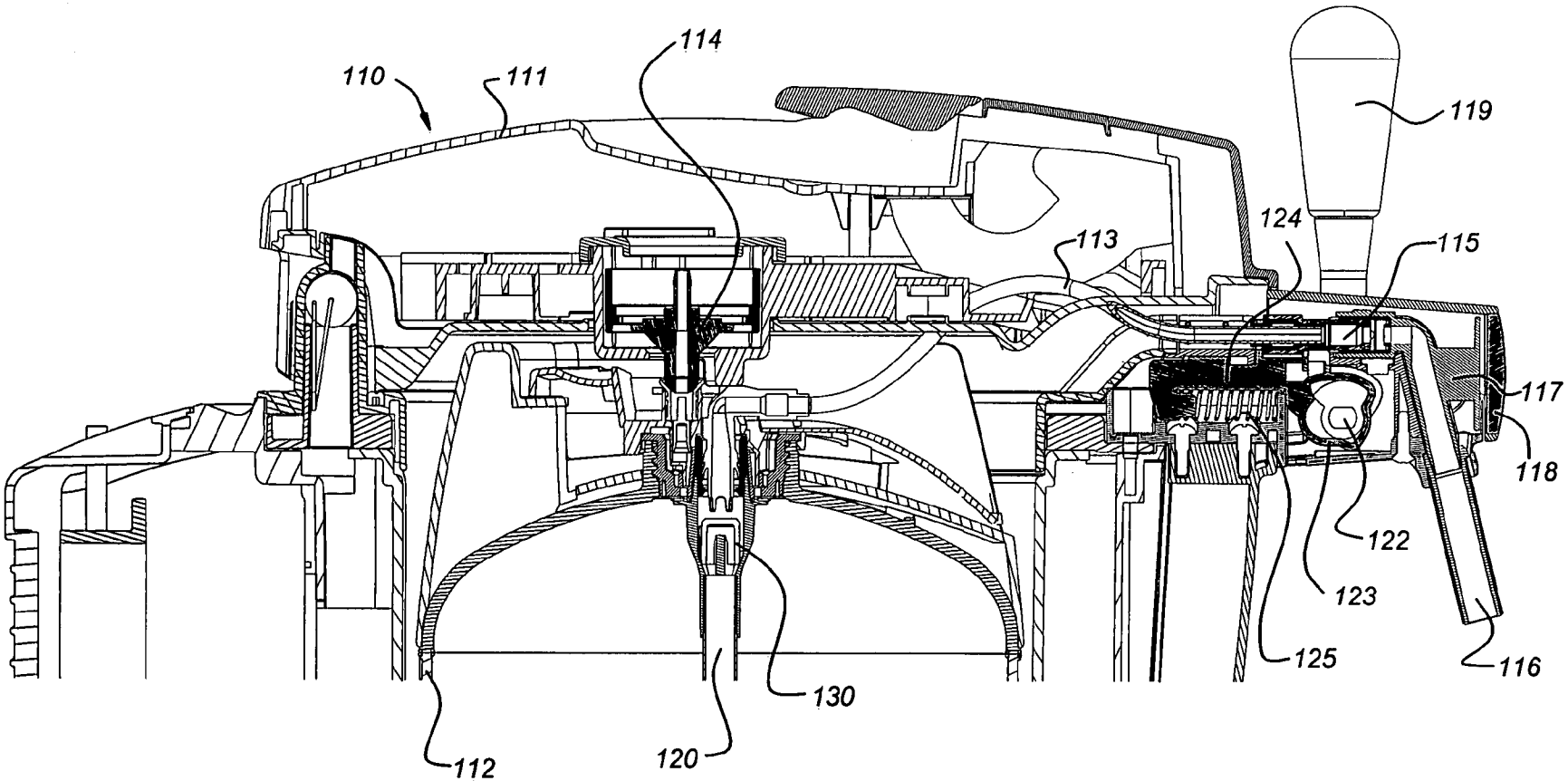
FIG. 11 shows a cross-sectional view of the upper part of a preferred drink dispenser assembly according to the invention.

FIG. 11 shows a preferred embodiment of a beverage dispensing system with a cooling chamber 110 and a beverage container 112 situated within the cooling chamber. In the lid 111 of the cooling chamber an air valve 114 is located which is connected to an air inlet at the top of the container 112. The air valve 114 in the lid 111 is connected to a compressor to provide pressurization of the contents of the container 112 such as beer, which is comprised in a flexible and compressible bag. By introducing air between the wall of the container 112 and the bag, beer can be dispensed from central tube 120 through flexible tube 113 via dispensing valve 115 and out through the outflow nozzle 116. Once the lid 111 is closed, the air valve 114 is connected to the container 112 and closing valve 130 is pressed in a downward direction such that the tube 120 is open and a free flow of pressurized beverage through tube 120 and flexible tube 113 is achieved. In the closed position of the cooling chamber 110, such as shown in FIG. 11, the user can dispense the contents from the container 112 through the outflow nozzle 116 by operating the handle 119. Rotation of handle 119 will cause cam surface 122 connected to the rotational axis of handle 119 to displace carrier 124 against the spring force of biasing spring 125.

Figure 12:
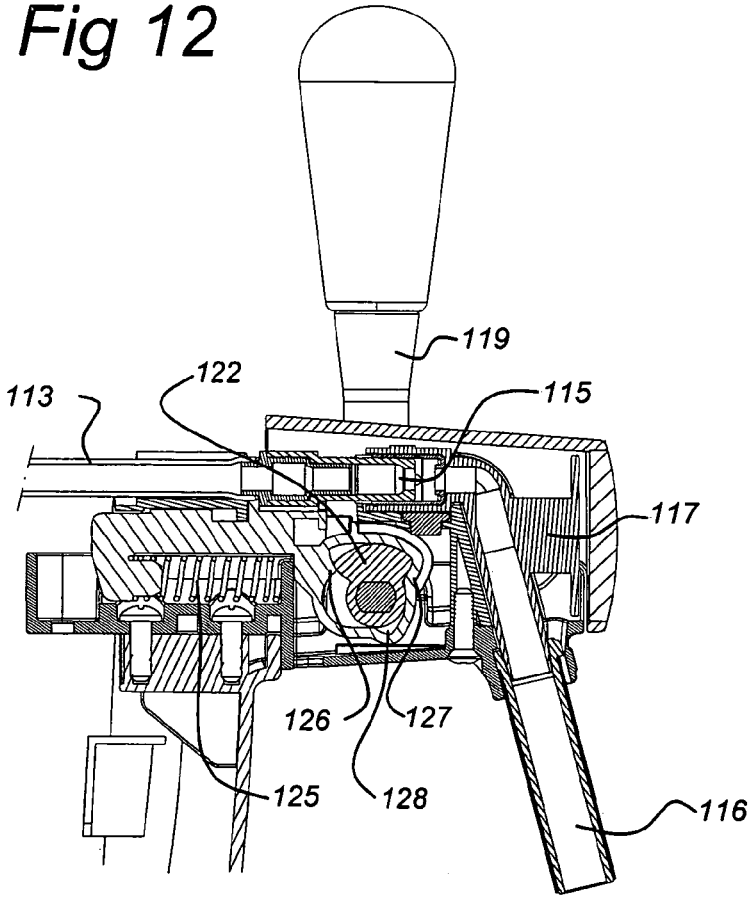
FIGS. 12 and 13 show enlarged details of the dispensing head of FIG. 11 in the closed and open state, respectively.
Figure 13:
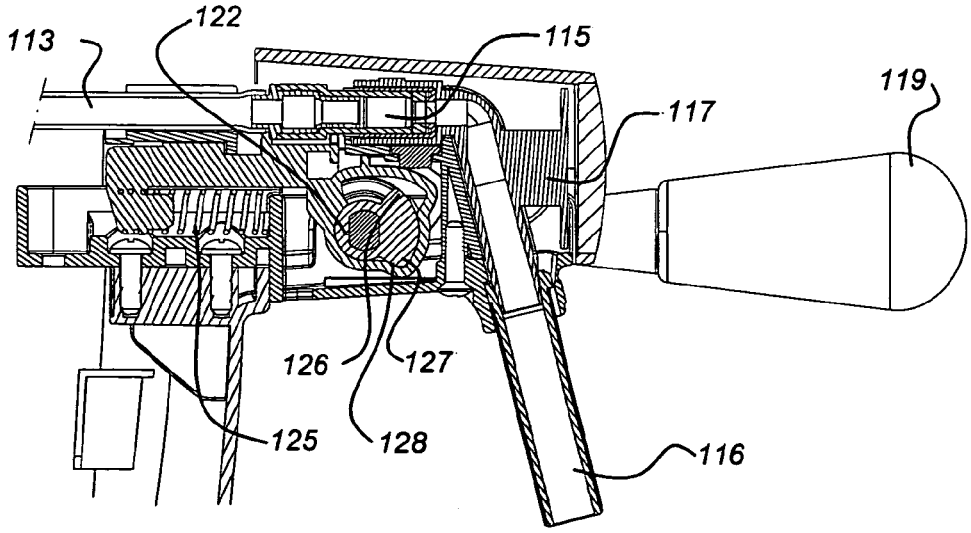

FIG. 12 shows the handle 119 and the operating mechanism connected thereto for opening and closing of the valve 115 in detail. Clearly, rotation of the handle 119 to open the valve 115 will first meet resistance from the projection 127 against the cam surface. After overcoming a "dead point", the projection 127 can easily slide along the curved trajectory towards the downward position, so that the handle 119 can be easily placed into the horizontal position as shown in FIG. 13. A firm grip is felt by the user by the force exerted by spring 125. At the end position, shown in FIG. 13, the projection 127 falls into a hollow part 128 of the cam surface such that a firm stop of the tap handle in the open position is achieved. Upon rotation of the handle 119 from the horizontal position shown in FIG. 13 back into the vertical position shown in FIG. 12, the spring force of spring 125 acts to quickly and with relatively little effort flip back the handle 119 and cause a sudden cut-off of beer flow, hence preventing dripping and foaming. The projection 126 on cam 122 will arrest the handle 119 into its properly defined right position.

The invention claimed is:

1. Drink dispenser assembly (25, 27) comprising:

a dispenser device (25) with a cooling chamber (26), a hollow column (30) supported on the cooling chamber, a dispensing head (29) on the column;

a flexible dispensing line (28) releasably attached to the dispensing head via a coupling element at an outlet end of the flexible dispensing line, and a container (27) containing carbonated drink, configured so as to be connected during use to the dispensing line (28), the coupling element (32) being detached from the dispensing head (29) by a user upon removal of a used said container from the cooling chamber (26), the coupling element (32) being attached to the dispensing head by said user upon placing of a new said container in the cooling chamber (26), wherein the cooling chamber is provided with a door for introducing the container into the cooling chamber, the cooling chamber being also provided with an outlet opening in a top wall communicating with the hollow column (32), the cooling chamber comprising a curved guide member (35) with a substantially vertically orientated downstream end situated inside the cooling chamber (26), and extending towards the outlet opening and with an entry end, at an angle to the downstream end, the curved guide member (35) having a substantially smooth wall, for guiding the flexible line and the coupling element (32), from the dispensing head (29) to the entry end of the curved guide member (35) upon said user removing said used said container from the cooling chamber (26), and for guiding the flexible line and the coupling element (32) from the entry end to the dispensing head (29), upon pushing the flexible line upwards through the guide member (35) by said user upon placing a new said container in the cooling chamber (26).

2. Drink dispenser assembly (25, 27) according to claim 1, the entry end being accessible via the door.

3. Drink dispenser assembly (25, 27) according to claim 1, wherein the guide member (35) is tubular and is increasing in width towards the entry end.

4. Drink dispenser assembly (25, 27) according to claim 1, the downstream end extending from the cooling chamber (26) to the dispensing head (29).

5. Container (27) for containing carbonated drink for use in the assembly according to claim 1, wherein the coupling element (32) at the end of the dispensing line (28) for connection to a dispensing head (29) of a dispenser device (25) is substantially rigid, the dispensing line (28) being of a length corresponding to at least a length of a tap column (30) on the dispenser device.

6. Container (27) according to claim 5, wherein the coupling element (32) comprises a tubular dispensing nozzle (41) and a removable cap (80) positioned over the dispensing nozzle.

7. Container (27) according to claim 6, wherein the removable cap (80) has a rounded tip.

8. Method of connecting a container comprising a carbonated beverage to a dispensing head of an assembly comprising a dispenser device (25) with a cooling chamber (26), a hollow column (30) supported on the cooling chamber and a dispensing head (29) on the column for accommodating a flexible dispensing line (28), and a container (27) containing carbonated drink, connected during use to the dispensing line (28) which has a coupling element (32) at an outlet end for connection to the dispensing head (29), wherein the cooling chamber is provided with a door for introducing the container into the cooling chamber and with an outlet opening in a top wall communicating with the hollow column (32), the cooling chamber comprising a curved guide member (35) with a substantially vertically orientated downstream end extending towards the outlet opening and with, an entry end, at an angle to the downstream, comprising the steps of:

placing the container into the cooling chamber, introducing the coupling element into the curved guide member, pushing the flexible dispensing line upwards into the hollow column, via the curved guide member, until the coupling element is situated at the top of the hollow column, engaging the coupling element with the dispensing head and closing the cooling chamber door.

9. A drink dispenser assembly comprising:

a dispenser device having a cooling chamber therein, the cooling chamber having a door;

a hollow column extending from the cooling chamber and having a curved upper portion;

a dispensing head attached to an upper end of the column;

a hollow curved guide member disposed within the hollow column, the hollow curved guide member having an upper curved portion positioned within the upper curved portion of the hollow column, a lower end of the hollow curved guide member being disposed within the cooling chamber;

a flexible dispensing line having an inlet and an outlet end, the outlet end being releasably attached to the dispensing head via a coupling element at the outlet end; and a container containing carbonated drink, configured so as to be connected to the inlet end of the flexible dispensing line;

wherein the hollow curved guide member and the flexible dispensing line are configured to allow a user to insert the outlet end of the flexible dispensing line into the lower end of the hollow curved guide member and feed the flexible dispensing line upward through the hollow curved guide member, including the upper curved portion of the hollow curved guide member, to the dispensing head by pushing the flexible dispensing line near the lower end of the hollow curved guide member.

10. The drink dispenser of claim 9, wherein the hollow curved guide member further comprises a lower curved portion disposed within the cooling chamber.

11. The drink dispenser of claim 10, wherein the lower curved portion of the hollow curved guide member providing a transition from a generally vertical section to a generally horizontal section of the hollow curved guide member.

12. The drink dispenser of claim 11, wherein the generally horizontal section of the hollow curved guide member is arranged within the cooling chamber.

13. The drink dispenser of claim 12, wherein the hollow curved guide member is generally tubular, the lower end of the hollow curved guide member, into which the flexible dispensing line can be inserted, being flared.

* * * * *